US005167213A

United States Patent [19]

Bassler et al.

[11] Patent Number: 5,167,213

[45] Date of Patent: Dec. 1, 1992

[54] FUEL INJECTION DEVICE FOR INTERNAL COMBUSTION ENGINES

[75] Inventors: Helmut Bassler, Weinstadt; Thomas Naeger, Stuttgart; Jochen Friedmann, Plochingen, all of Fed. Rep. of Germany

[73] Assignee: Robert Bosch GmbH, Stuttgart, Fed. Rep. of Germany

[21] Appl. No.: 828,896

[22] PCT Filed: Apr. 25, 1991

[86] PCT No.: PCT/DE91/00343

§ 371 Date: Jan. 31, 1992

§ 102(e) Date: Jan. 31, 1992

[87] PCT Pub. No.: WO91/19091

PCT Pub. Date: Dec. 12, 1991

[30] Foreign Application Priority Data

Jun. 2, 1990 [DE] Fed. Rep. of Germany ..... 4017875

[51] Int. Cl.[5] ..... F02M 39/00

[52] U.S. Cl. ..... 123/470; 123/456

[58] Field of Search ..... 123/470, 469, 468, 472, 123/456; 239/600

[56] References Cited

U.S. PATENT DOCUMENTS

| | | | |
|---|---|---|---|
| 4,474,160 | 10/1984 | Gartner | 123/490 |
| 4,570,602 | 2/1986 | Atkins | 123/456 |
| 4,823,754 | 4/1989 | Minamoto | 123/456 |
| 4,984,548 | 1/1991 | Hudson | 123/468 |
| 4,991,557 | 2/1991 | Degrace | 123/468 |
| 4,993,390 | 2/1991 | Ono | 123/456 |
| 5,005,878 | 4/1991 | Smith | 123/470 |
| 5,035,224 | 7/1991 | Hornby | 123/470 |
| 5,040,512 | 8/1991 | Twilton | 123/456 |
| 5,058,554 | 10/1991 | Takeda | 123/456 |
| 5,074,269 | 12/1991 | Herbon | 123/456 |

*Primary Examiner*—Carl S. Miller

*Attorney, Agent, or Firm*—Edwin E. Greigg; Ronald E. Greigg

[57] ABSTRACT

A fuel injection device for internal combustion engines has a fuel distributor which bears a plurality of connection pieces with radially projecting locking elements, and has a plurality of fuel injection valves, which are designed as so-called top-feed valves and are inserted fluid-tightly into the connection pieces. Provided to hold the fuel injection valves in the axial direction and to secure the fuel injection valves against rotation in the circumferential direction there is in each case a connecting member which engages in a circumferential groove in the valve casing and engages over the locking elements. In addition, the connection member has a fixing element which engages positively, at least in the circumferential direction, around a shaped element which is provided on the valve casing at a defined position.

15 Claims, 2 Drawing Sheets

FUEL INJECTION DEVICE FOR INTERNAL COMBUSTION ENGINES

PRIOR ART

Figure 1:
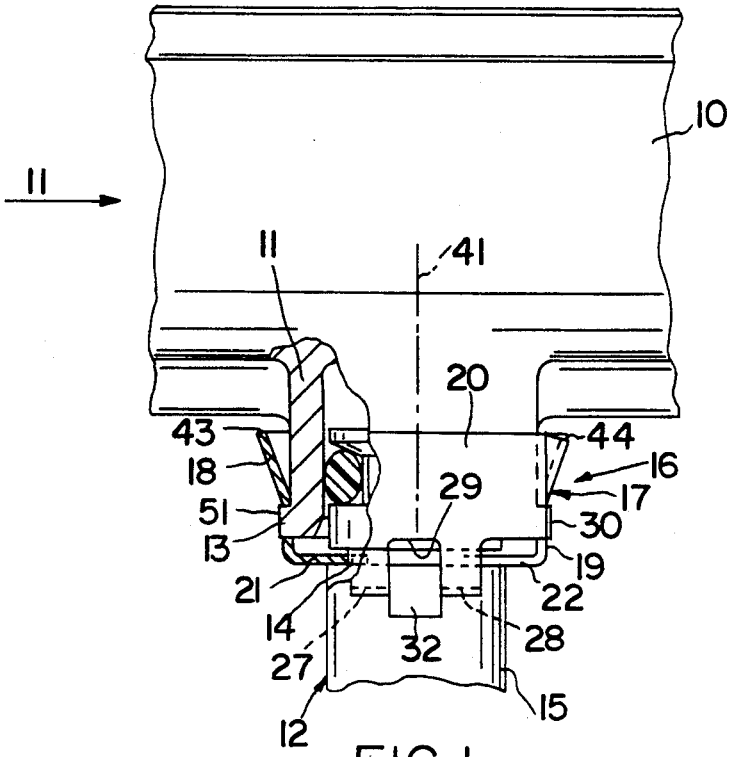

The invention relates to a fuel injection device for internal combustion engines.

In a known fuel injection device of this kind (DE 34 28 597 C2), the connecting member is designed as a U-shaped spring clip, the web of which extends transversely to the longitudinal extension of the fuel injection valve and the legs of which, on the one hand, engage in a circumferential groove on the valve casing of the fuel injection valve by tabs bent radially inwards at the edge and, on the other hand, have openings into which a locking collar running round the connection piece can be snapped. For the radial fixing of the spring clip in the circumferential groove of the valve casing, the tabs have portions which extend concavely and in a circular arc, the radius of which corresponds to that of the circumferential groove. During assembly, the spring clip is first of all pushed onto the fuel injection valve, the legs snapping into the circumferential groove with their tabs. The fuel injection valve provided with the spring clip is then pushed axially into the connection piece. To ensure that the legs can slide over the locking collar, they are bent outwards in the direction of insertion and are spread apart by the locking collar during insertion. As soon as the locking collar has snapped into the openings, the legs spring back into their initial position.

Although, in such a fuel injection device, axial securing of the fuel injection valves against being unintentionally pulled off the fuel distributor is ensured, securing against rotation of the fuel injection valves in the circumferential direction, as can occur, for example, during assembly or during the fitting or removal of the connecting cables for the fuel injection valves, is not. However, when so-called multi-spray fuel injection valves are used, exact positioning of the individual spray planes of the fuel injection valves in relation to the intake geometry of the internal combustion engine is required, and this positioning must not be changed since any deviation from this position due to rotation in the circumferential direction leads to deterioration in the mixture preparation and to non-uniform distribution of the fuel between the individual cylinders of the internal combustion engine.

It has furthermore been proposed (patent application Ser. No. P 39 18 410.2) that for fixing the fuel injection valve in the circumferential direction in a fuel injection device, shaped elements, with which in each case one fixing element on the spring clip interacts, be provided on the connection piece and on the valve casing. This results in great expense, since the shaped element is necessary on the connection piece in addition to the locking collar and an upper and lower fixing element are necessary on the spring clip.

ADVANTAGES OF THE INVENTION

The fuel injection device according to the invention, has the advantage that the fuel injection valves inserted into the connection piece and held by means of the connecting members are installed in a precise fashion in the circumferential direction in terms of tolerances and in a simple, cost-effective and functionally reliable manner, and rotation simply by the exertion of force from outside, e.g. by fitting or removing the connecting cables, is no longer possible. The connecting members are simple to manufacture and make possible easy and automatic assembly. The shaped elements on the fuel injection valves can be allowed for in the mould itself and do not lead to any significant additional costs in manufacture. There are no special shaped elements on the connection pieces and only one fixing element is required on the connecting member. The correct positioning of the fuel injection valves as regards the intake geometry of the internal combustion engine can be reproduced with high precision even after disassembly for servicing purposes and is reliably maintained even under rough operating conditions.

Advantageous further developments and improvements of the fuel injection device are possible by means of the measures presented hereafter.

DRAWING

An illustrative embodiment of the invention is represented in simplified form in the drawing and explained in greater detail in the description which follows.

Figure 2:
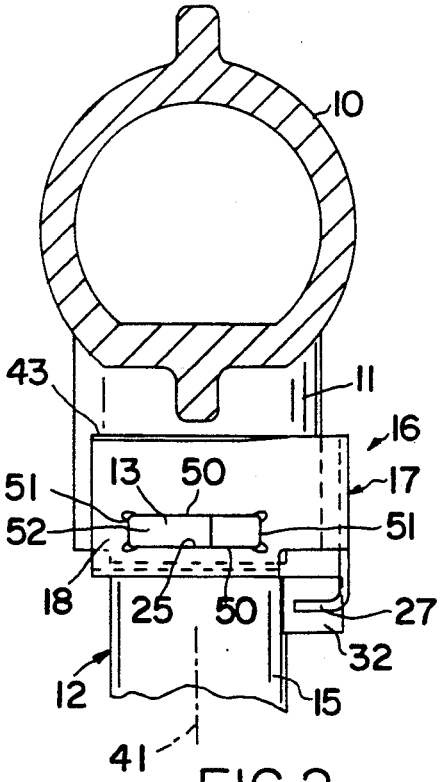
Figure 3:
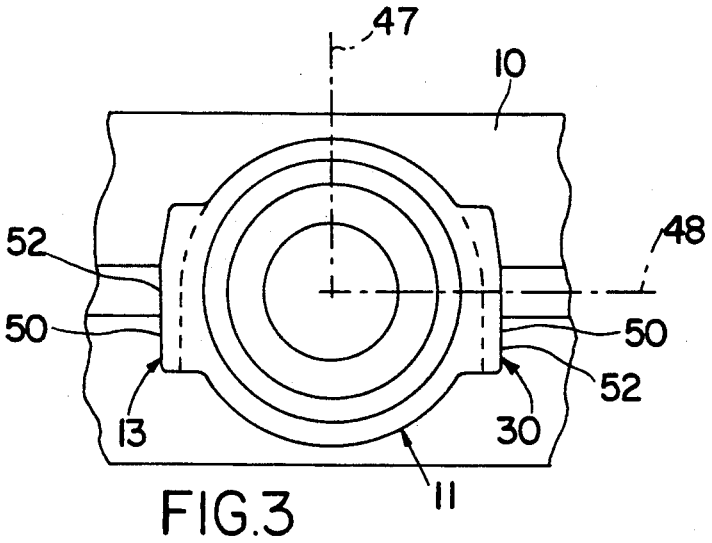
Figure 4:
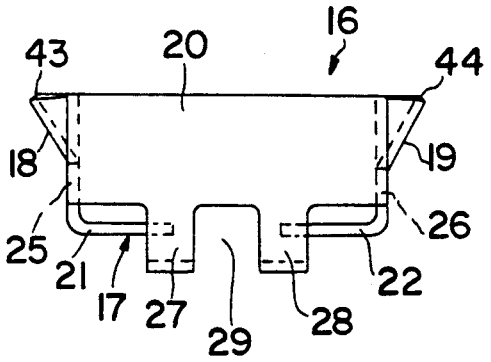
Figure 5:
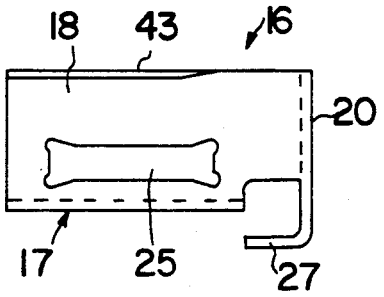
Figure 6:
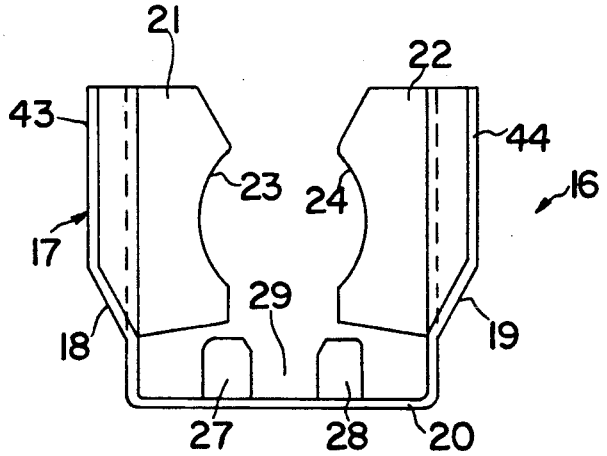

FIG. 1 shows a partial side view of a fuel injection device, partially in section, FIG. 2 shows a view of the fuel injection device in the direction of arrow II in FIG. 1, FIG. 3 shows a bottom view of the fuel injection device in FIG. 1 with the fuel injection valve removed, FIG. 4 shows a front view of a connecting member in the fuel injection device according to FIGS. 1 to 3, FIG. 5 shows a side view of the connecting member in FIG. 4, and, FIG. 6 shows a plan view of the connecting member in FIG. 4.

DESCRIPTION OF THE ILLUSTRATIVE EMBODIMENT

The fuel injection device for internal combustion engines, part of which is shown, partially in section, in FIGS. 1 and 2, in two different side views, as a fuel distributor 10 of plastic or, for example, aluminium which bears a plurality of connection pieces 11 and an equal number of fuel injection valves 12 with a connection opening at one end for the supply of fuel. Such fuel injection valves 12 are generally referred to as top-feed valves. The number of connection pieces 11 on the fuel distributor 10 and the number of fuel injection valves 12 can correspond to the number of cylinders of the internal combustion engine which are to be supplied or can be less. Thus, in the case of a four-cylinder internal combustion engine, four fuel injection valves 12 are to be provided, each being inserted fluid-tightly into one of four connection pieces 11 on the fuel distributor 10.

For the purpose of holding the fuel injection valves 12, each connection piece 11 is provided at the free end with two radially projecting locking elements 13, 30 and each fuel injection valve 12 is provided with a circumferential groove 14 in its valve casing 15 and for each fuel injection valve 12 there is a connecting member 16 which, on the one hand, engages in the circumferential groove 14 and, on the other hand, engages over the locking elements 13, 30.

An illustrative embodiment of such a connecting member 16 is depicted in FIGS. 4 to 6. It is formed by an approximately U-shaped spring clip 17 which is manufactured from a sheet-metal stamping or is designed as an injection-moulded plastics part. The spring clip 17 has two spring legs 18, 19 and a spring web 20 connecting the latter. In the functioning position of the spring clip 17, spring legs 18, 19 and spring web 20 each extend approximately parallel to the center line 41 of connection piece 11 and fuel injection valve 12. Projecting approximately at right angles from each spring leg 18, 19 is an inward-directed tab 21 and 22, respectively, which engages in the circumferential groove 14 in the valve casing 15 by means of a contour 23 and 24, respectively, matched to the said circumferential groove. As can be seen, in particular, from FIG. 4 and 5, the spring legs 18, 19 each have a longitudinally extending rectangular opening 25 and 26, respectively, the width of which, in the direction of the center line 41, is dimensioned such that each locking element 13, 30 on the connection piece 11 can pass through the openings 25, 26 and is thus engaged over on both sides by the spring legs 18, 19. In their longitudinal edge region 43, 44 pointing towards the connection piece 11, the spring legs 18, 19 are angled obliquely outwards, allowing them to be pushed easily onto the connection pieces, preferably by machine. Two sheet segments 27, 28 extend approximately parallel to the center line 41 from the spring web 20. The sheet segments 27, 28 form a fixing element in the form of a central, longitudinally extending slot 29 which is open towards the free end of the sheet segments 27, 28, which end faces away from the spring web 20. The rectangular sheet segments 27, 28, which point towards the fuel injection valve 12, are bent inwards in the end region facing away from the spring web 20.

Arranged on the outside of the valve casing 15 of each fuel injection valve 12 so as to correspond to the slot 29 is a shaped element in the form of a radially projecting boss, web or rib 32. With the angled end of the slot 29, the spring clip 17, which has, on the one hand, been snapped into the circumferential groove 14 on the valve casing 15 and, on the other hand, onto the locking elements 13, 30 of the connection piece 11, in each case engages around the boss 32 positively in the circumferential direction. The spring clip 17 thereby locks the fuel injection valve 12 to the connection piece 11 both in the axial direction and in the circumferential direction, with the result that, without the exertion of an external force, it can neither be pulled off in the axial direction nor rotated in the circumferential direction. The bosses 32 are provided at a defined position with the result that, after engagement on the connection piece 11, the fuel injection valve 12, designed as a multi-spray valve, is exactly positioned as regards its spray planes in relation to the intake geometry in the internal combustion engine.

The two locking elements 13, 30 extend at a mutual spacing on the circumference of the connection piece 11 and extend over only a part of this circumference. At the same time, the locking elements 13, 30 are of mirror-image design and arranged essentially symmetrically to a plane 47 of symmetry which extends through the center line 41 and perpendicularly to a longitudinal axis 48 of the fuel distributor 10. Each locking element 13, 30 has a rectangular cross-section with longitudinal sides 50 extending in the circumferential direction of the connection piece 11 and narrow sides 51 extending perpendicularly to the said longitudinal sides. In order to achieve secure locking against rotation, at least one narrow side 51 of each locking element 13, 30 is designed in such a way that, facing away from the connection piece 11, it projects with a sharp edge out of the respective rectangular opening 25, 26 of the spring clip 17. At the same time, the narrow sides 51 of the locking elements 13, 30 which project out of the respective opening 25, 26 are symmetrical to the plane 47 of symmetry, i.e. on the same side of the longitudinal axis 48. Each locking element 13, 30 has a front face 52 which, starting from the narrow side 51 projecting out of the opening 25, 26, first of all extends parallel and then obliquely to the plane 47 of symmetry, as far as the other narrow side 51. This ensures that the spring clip 17 is not expanded excessively during assembly. Each opening 25, 26 surrounds one of the locking elements 13, 30, in each case completely.

Each of the locking elements 13, 30 can, of course, also have some other suitable cross-section, for example oval, rhombic, triangular or the like, in which case the openings 25, 26 of the spring clip 17 are then adapted in corresponding fashion.

The foregoing relates to a preferred exemplary embodiment of the invention, it being understood that other variants and embodiments thereof are possible within the spirit and scope of the invention, the latter being defined by the appended claims.

We claim:

1. Fuel injection device for internal combustion engines, with a fuel distributor which has a plurality of connection pieces bearing radially projecting locking elements, with a plurality of fuel injection valves which are inserted fluid-tightly by their end containing a connection opening into in each case one connection piece, and with a connecting member which, for the purpose of holding the fuel injection valve on the connection piece, on the one hand, engages in a circumferential groove on the valve casing and, on the other hand, engages over the locking element by means of two openings, to ensure a predetermined position of the fuel injection valve when the fuel injection valve is held on the connection piece, a shaped element being provided on the valve casing at a defined position and the connecting member bearing a fixing element which engages on the shaped element, provided at a distance on each connection piece (11) and essentially symmetrically to one another with respect to a plane (47) of symmetry extending through a center line (41) of the connection piece (11) are two locking elements (13, 30) which extend only part way in the circumferential direction of the connection piece (11), and each locking element (13, 30) is surrounded by one of the openings (25, 26).

2. Device according to claim 1, in that each locking element (13, 30) has a rectangular cross-section with longitudinal sides (50) extending in the circumferential direction of the connection piece (11) and narrow sides (51) extending perpendicularly to the said longitudinal sides, and each of the locking elements (13, 30) projects out of the respective opening (25, 26) with at least one of its narrow sides (51), on the side facing away from the connection piece (11).

3. Device according to claim 2, in that the narrow sides (51) of the locking elements (13, 30), which narrow sides project out of the respective opening (25, 26), are symmetrical to the plane (47) of symmetry.

4. Device according to claim 3, in that each locking element (13, 30) has a front face (52) which, starting from the narrow side (51) projecting out of the opening (25, 26), first of all extends parallel and then obliquely to the plane (47) of symmetry, as far as the other narrow side (51).

5. Device according to claim 2, in that the opening (25, 26) has a rectangular cross-section.

6. Device according to claim 1, in that the shaped element on the valve casing (15) is designed as an essentially axially extending web, boss or rib (32) projecting radially from the valve casing (15) and the fixing element on the connecting member (16) is designed as an essentially axially extending slot 29 which is open towards one end of the connecting member (16).

7. Device according to claim 1, in that the connecting member (16) is designed as a U-shaped spring clip (17) with two spring legs (18, 19) and a spring web (20) connecting the said legs and extending approximately parallel to the center line (41) of valve casing (15) and fuel injection valve (12), in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

8. Device according to claim 7, in that, in their longitudinal edge region pointing towards the connection piece (11), the spring legs (18, 19) are angled obliquely outwards.

9. Device according to claim 7 in that the spring clip (17) is manufactured from a sheet-metal stamping or is designed as an injection-moulded plastics part.

10. Device according to claim 8, in that the spring clip (17) is manufactured from a sheet-metal stamping or is designed as an injection-moulded plastics part.

11. Device according to claim 2, in that the connecting member (16) is designed as U-shaped spring clip (17) with two spring legs (18, 19) and a spring web (20) connecting the said legs and extending approximately parallel to the center line (41) of valve casing (15) and fuel injection valve (12), in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

12. Device according to claim 3, in that the connecting member (16) is designed as a U-shaped spring clip (17) with two spring legs (18, 19) and a spring web (20) connecting the said legs and extending approximately parallel to the center line (410) of valve casing (15) and fuel injection valve (12), in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

13. Device according to claim 4, in that the connecting member (16) is designed as a U-shaped spring clip (17) with two spring legs (18, 19) and a spring web (20) connecting the said legs and extending approximately parallel to the center line (410) of valve casing (15) and fuel injection valve (12); in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

14. Device according to claim 5, in that the connecting member (16) is designed as a U-shaped spring clip (17) with two spring legs (18, 19) and a spring web (20) connecting the said legs and extending approximately parallel to the center line (41) of valve casing (15) and fuel injection valve (12), in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

15. Device according to claim 6, in that the connecting member (16) is designed as a U-shaped spring clip (17) with two spring legs (18, 19) and a spring web (20) connecting the said legs and extending approximately parallel to the center line (41) of valve casing (15) and fuel injection valve (12), in that projecting approximately at right angles from each spring leg (18, 19) is an inward-directed tab (21, 22) which engages in a circumferential groove (14) in the valve casing (15) by means of a contour (23, 24) matched to the said circumferential groove, in that the spring legs (18, 19) each have a longitudinally extending opening (25, 26) through which the locking elements (13, 30) on the connection piece (11) are intended to project, and in that the fixing element (29) extends transversely to and approximately in the center of the spring web (20).

* * * * *